United States Patent [19]

Levy

[11] 4,025,343

[45] May 24, 1977

[54] IMAGE RECEIVING ELEMENTS COMPRISING STANNIC OXIDE POLYMERS HAVING NOBLE METALS REDUCED THEREON

[75] Inventor: Boris Levy, Wayland, Mass.

[73] Assignee: Polaroid Corporation, Cambridge, Mass.

[22] Filed: Jan. 14, 1976

[21] Appl. No.: 649,202

[52] U.S. Cl. ..... 96/3; 96/25; 96/29 R; 96/76 R; 96/80; 428/539

[51] Int. Cl.[2] ..... G03C 7/00; G03C 5/54; G03C 1/48; G03C 1/84

[58] Field of Search ..... 96/29 R, 3, 76 R, 25, 96/80; 428/539

[56] References Cited

UNITED STATES PATENTS

| | | | |
|---|---|---|---|
| 3,345,169 | 10/1967 | McGuckin | 96/29 R |
| 3,532,518 | 10/1970 | D'Ottavio | 106/1 |
| 3,615,428 | 10/1971 | Weed | 96/76 R |
| 3,647,440 | 3/1972 | Rasch | 96/76 R |
| 3,890,429 | 6/1975 | Pytlewski | 423/544 |

*Primary Examiner*—Edward C. Kimlin
*Assistant Examiner*—Richard L. Schilling
*Attorney, Agent, or Firm*—Philip G. Kiely

[57] ABSTRACT

Novel image-receiving elements for obtaining photographic images in silver which comprise a support carrying, as a silver precipitating layer, a layer of inorganic stannic oxide polymer (tin hydrosol) having a noble metal reduced thereon.

23 Claims, 11 Drawing Figures

40,000 X 0.5μ

IMAGE RECEIVING ELEMENTS COMPRISING STANNIC OXIDE POLYMERS HAVING NOBLE METALS REDUCED THEREON

BACKGROUND OF THE INVENTION

Procedures for preparing photographic images in silver by diffusion transfer principles are well known in the art. For the formationn of the positive silver images, a latent image contained in an exposed photosensitive silver halide emulsion is developed and almost concurrently therewith, a soluble silver complex is obtained by reaction of a silver halide solvent with the unexposed and undeveloped silver halide of said emulsion. Preferably, the photosensitive silver halide emulsion is developed with a processing composition in a viscous condition which is spread between the photosensitive element comprising the silver halide emulsion and a print-receiving element comprising a suitable silver precipitating layer. The processing composition effects development of the latent image in the emulsion and, substantially contemporaneously therewith, forms a soluble silver complex, for example, a thiosulfate or thiocyanate, with undeveloped silver halide. This soluble silver complex is, at least in part, transported in the direction of the print-receiving element and the silver thereof is precipitated in the silver precipitating element to form a positive image thereon. Procedures of this description are disclosed, for example, in U.S. Pat. No. 2,543,181 issued to Edwin H. Land. See, also, Edwin H. Land, *One Step Photography* , Photographic Journal, Section A, pp. 7–15, January 1950.

Additive color reproduction may be produced by exposing a photosensitive silver halide emulsion through an additive color screen having filter media or screen elements each of an individual additive color, such as red or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426, and 3,894,871.

In general, silver precipitating nuclie comprise a specific class of adjuncts well known in the art as adapted to effect catalytic reduction of solubilized silver halide specifically including heavy metals and heavy metal compounds such as the metals of Groups IB, IIB, IVA, VIA and VIII and the reaction products of Groups IB, IIB, IVA and VIII metals with elements of Group VIA, and my be effectively employed in the conventional concentrations traditionally employed in the art.

Widely used as silver precipitating agents are those disclosed in U.S. Pat. No. 2,698,237 and specifically the metallic sulfides and selenides, there detailed, there terms being understood to include the selenosulfides, the polysulfides, and the polyselenides. For best results it is preferred to employ sulfides whose solubility products in an aqueous medium at approximately 20° C. vary between $10^{-23}$ and $10^{-49}$, and especially the salts of zinc. Also particularly suitable as precipitating agents are heavy metals such as silver, gold, platinum, palladium, etc,. and in this category the noble metals illustrated are preferred and are generally provided in a matrix as colloidal particles.

SUMMARY OF THE INVENTION

The present invention is directed to a novel image-receiving element for obtaining images in silver, which comprises a support carrying as a silver precipitating layer a layer of an inorganic polymer in which stannic oxide monomeric units comprise the principal repeating units and which further contain metallic monomeric units having a valence of +2 having a noble metal reduced thereon. More specifically, the silver precipitating layer comprises the reaction product of a stannic/stannous oxide polymer and a palladous salt.

DETAILED DESCRIPTION OF THE INVENTION

Figure 1:
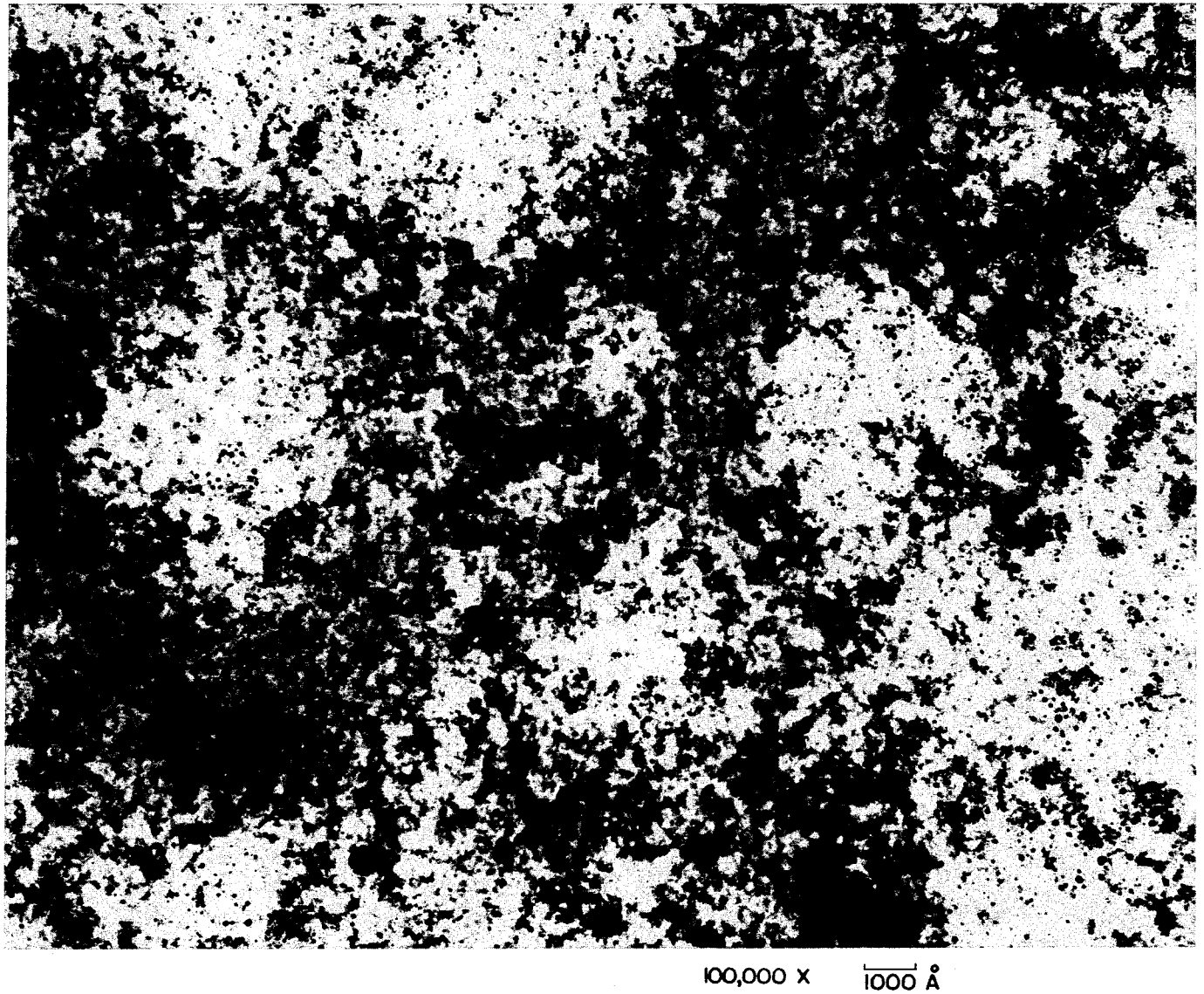
FIG. 1 is an electron micrograph at 100,000 magnification showing the novel silver precipitating nuclei of the present invention.

The novel image-receiving element of the present invention comprises a support having a uniform layer of an inorganic stannic oxide polymer thereon with noble metal nucleating sites deposited on said polymer by in situ reduction of a noble metal salt or complex. When empolyed in a silver diffusion transfer photographic process, image silver deposits on the thus-formed noble metal nuclei. While noble metals, such as gold, platinum and palladium, are known in the art as silver nucleating materials, generally they are disposed in an organic polymeric matrix or vacuum deposited on a substrate. In the present invention, it is not necessary to employ a binder or matrix material to retain the nucleating sites or to employ the difficult procedures and apparatus involved in vacuum deposition. However, if desired, a conventional matrix may be employed.

It has been found that by employing the receiving layer of the present invention, more blue-black tone and better color discrimination can be achieved in the described additive color film units. In addition, more dense packing of the positive silver is obtained and more versatility with respect to the employment of other materials in the film unit is possible.

The desirability of providing diffusion transfer additive color film units which provide a positive silver image of high maximum density and a negative silver image or relatively low maximum density has been recognized in the prior art (see, for example, U.S. Pat. Nos. 2,861,885; 3,536,488 and 3,894,871). The indicated patents as well as others set forth above, disclose a positive transfer image and a negative transfer image, the two images being in separate layers on a common, transparent support and viewed as a single positive image. Such positive images may be referred to for convenience as "integral positive-negative images" or as "integral positive-negative transparencies." The silver precipitating layers of the present invention is particularly suitable for use in such integral structures.

A class of inorganic polymers is known in which stannic oxide monomeric units are the principal repeating units and which further contains metallic monomeric units of metals having a valence of +2, +3 or +4.

The above-mentioned inorganic polymers are composed of a major amount of stannic oxide units of the formula:

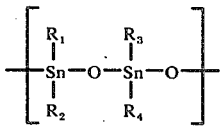

I.

wherein at least one of the groups $R_1$, $R_2$, $R_3$ and $R_4$ is —OH or —O— and at least one of the groups from $R_1$, $R_2$, $R_3$ and $R_4$ is an anion of a water soluble salt of tin such as chloride, bromide, nitrate, sulfate and the like. The remainder of the groups $R_1$, $R_2$, $R_3$ and $R_4$ are OH, —O— or an anion as defined above. The stannic oxide monomeric units of Formula I in a given polymer can be the same or different. When none of the groups $R_1$, $R_2$, $R_3$, and $R_4$ are an —O— group, the polymers which are produced are linear in nature. However, when one or more of the groups $R_1$, $R_2$, $R_3$, and $R_4$, is an —O— group, the polymer chains can crosslink with each other to produce a three dimensional polymeric structure. The polymers also contain a second type of monomeric unit as pointed out above. These monomeric units are metal oxide monomers of the formulae:

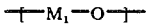

II.

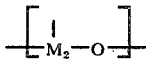

III.

and mixtures thereof, wherein $M_1$ is a metallic ion of a metal having a valence of +2 and $M_2$ is a metallic ion of a metal having a valence of +3. The metal oxide monomeric unit that is employed as the second monomeric unit can be selected from the oxide of various metals which have two stable states of oxidation in an aqueous system. The metal includes, for example, iron, cobalt, nickel, bismuth, lead, titanium, vanadium, chromium, copper, molybdenum, antimony, tungsten, and most preferably tin.

The amount of monomeric units of Formula II or Formula III employed is not critical.

The exact structure of the resulting polymer is not precisely known. It is believed, however, that when a monomeric unit of Formula II is used that the polymer is comprised of monomeric units connected in the following manner:

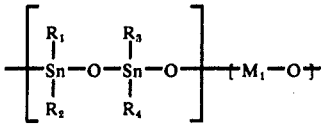

When one or more of the groups $R_1$, $R_2$, $R_3$, and $R_4$ is —O—, sidechains can form and cross-linking can also occur especially when the monomeric units of the formula

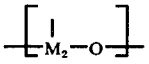

are included in the polymer chain. Such a polymer could have, for example, the following formula:

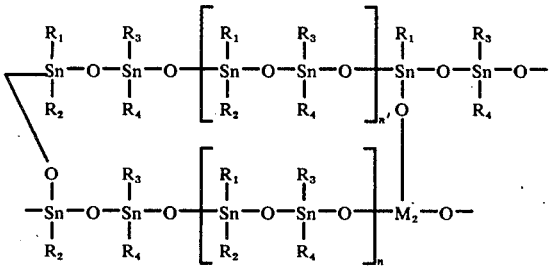

The letters $n$ and $n'$ in the above formula represent a relatively large number, for example 50 to 10,000.

As can be seen from the above formulae, there is a large variety of different polymeric structures which can be produced.

A highly advantageous polymer of this type is the polymer comprised of stannic oxide and stannous oxide monomeric units. This polymer is comprised of monomeric units of the formulae:

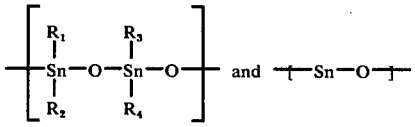

The polymer is produced in an aqueous reaction medium and is colloidal in character. Even if the water of the hydrosol is completely removed, the resulting polymer can be redispersed by the addition of water and the product will still be a stable colloidal dispersion of the polymer.

The polymers are prepared in the form of a hydrosol by dissolving the tin +4 salts in water. The +2, +3 or +4 metallic salts or finely divided metal is added to the aqueous mixture. The aqueous mixture is then carefully heated up to a point somewhat below the boiling point of the reaction mixture. As the temperature increases, there will be a change in the color of the reaction mixture. This change in color is believed to be due to a rapid electron exchange between the higher valent and the lower valent ions. The color of the solution is an indication of the degree of polymerization of the polymer with a deeper color being indicative of a higher molecular weight. The desired molecular weight of the resulting polymer is dependent upon the intended end use of the polymer as will be explained in greater detail below. After the desired degree of polymerization has been achieved, as determined, for example, by an evaluation of the color of the reaction mixture, the reaction mixture is allowed to cool to room temperature.

The polymer can be isolated using conventional methods. However, it is generally not necessary for most purposes to have the polymer in the absolute pure form. As noted above, the polymers of this invention have a strong positive charge. The residues from the reaction are, relative to the polymer, either insoluble, electrically neutral or noncolloidal. When the polymer is applied to a negatively charged substrate, the polymer adheres to the negatively charged substrate due to the difference in the charges of the substrate and the polymers and possibly chemical bonding. When the substrate is washed with water, the residues and excess amounts of polymer will be removed.

More details regarding the inorganic stannic oxide polymers may be found in U.S. Pat. No. 3,890,429 which is incorporated by reference therein.

The inorganic stannic oxide polymers are easily deposited on a suitable support, preferably a polymeric support. The inorganic polymers are known to the art to possess a high degree of adhesion for many surfaces. Thus, the methods of deposition employed can be dipping, spraying, curtain coating, roller coating, slot coating, and the like. Any excess may be washed off with water. A relatively thin uniform layer of inorganic plymer remains on the surface. The noble metal nucleating sites are then generated on the inorganic polymer layer. It is not necessary that the inorganic polymer layer be dried prior to the application of the noble metal compound. The thickness of the nucleating layer is generally in the range of 10 to 1000 A.

The noble metals may be applied to the inorganic stannic oxide polymer by a variety of methods. Preferably, an aqueous solution of a noble metal salt or complex is applied to the inorganic polymer layer. It is believed that the inorganic polymer forms a reactive matrix for the noble metal at the $M^{+2}$ sites where $M^{+2}$ is preferably $Sn^{+2}$.

The aforementioned coated support constitutes the image-receiving element of the present invention and is ready for use in a silver diffusion transfer photographic process.

In an alternative embodiment, successive coatings of the noble metal nucleating layers may be employed, in some cases separated by layers of a suitable polymeric binder such as deacetylated chitin or gelatin. In a preferred embodiment, however, a single deposition of the silver precipitating layer is employed.

Figure 2:
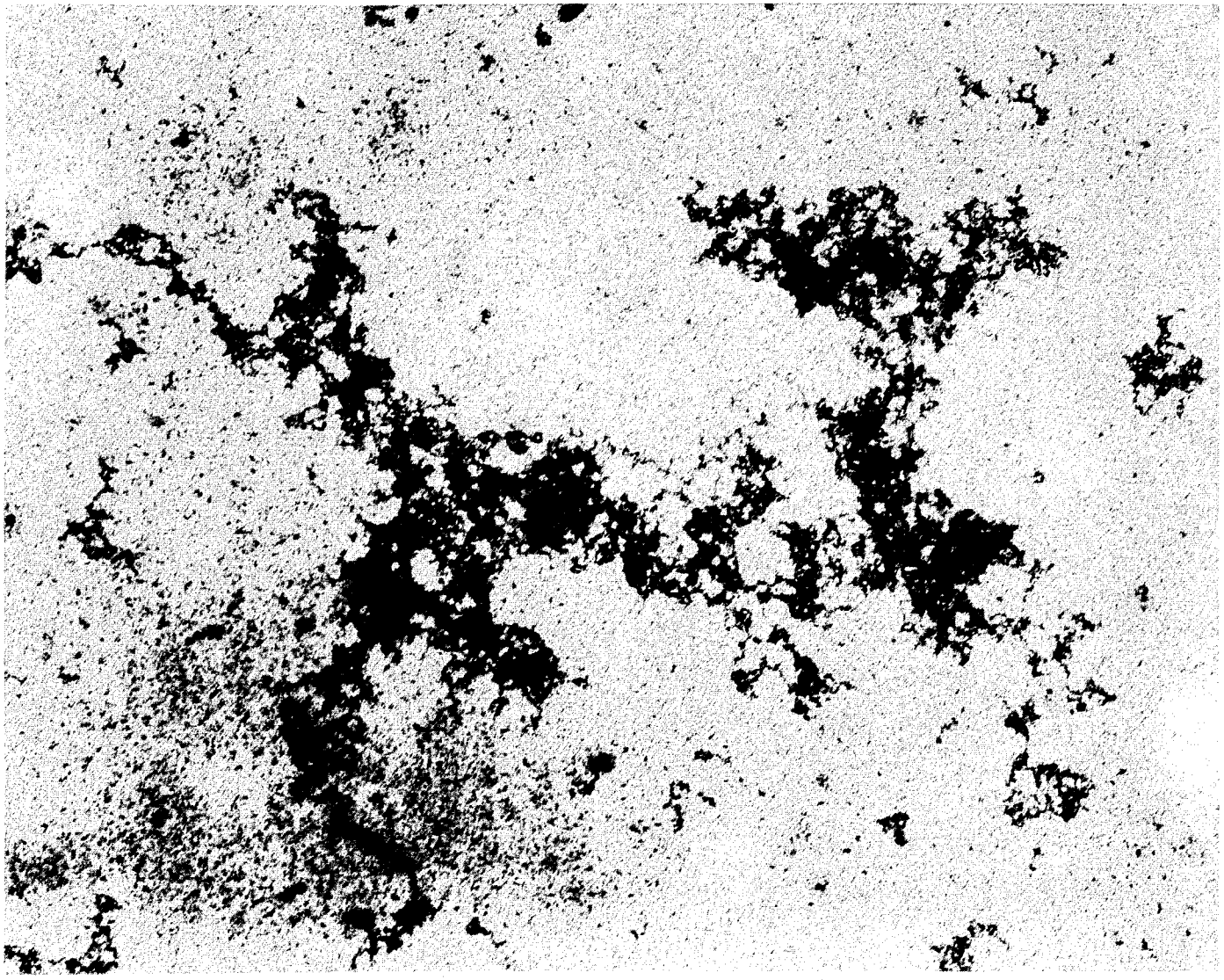
FIG. 2 is an electron micrograph at 100,000 magnification showing another embodiment of the present invention.
Figure 3:
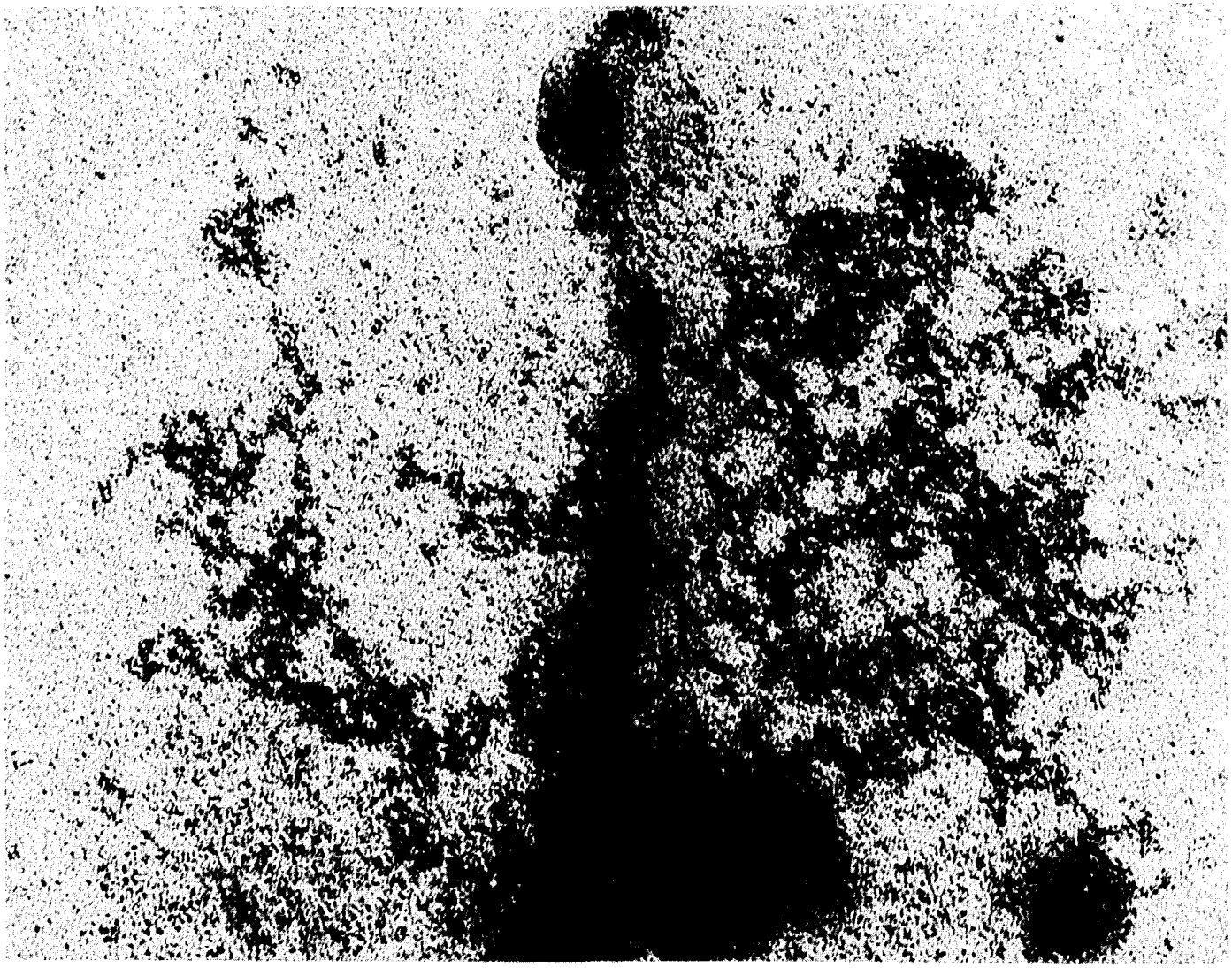
FIG. 3 is the same as FIG. 2 except at 300,000 magnification.

The size of the nuclei formed are extremely small and may vary over a relatively wide range. FIGS. 1, 2 and 3 are electron micrographs. FIG. 1 shows the nucleating layer at 100,000X magnification formed from the reaction product of an inorganic stannic oxide polymer (see Example I below) and 0.0014M $HAuCL_4$. FIGS. 2 and 3 show the nucleating layer at 100,000X and 300,000X magnification, respectively, formed by the reaction product of an inorganic stannic oxide polymer and 0.1M $K_2PdCl_4$.

Figure 4:
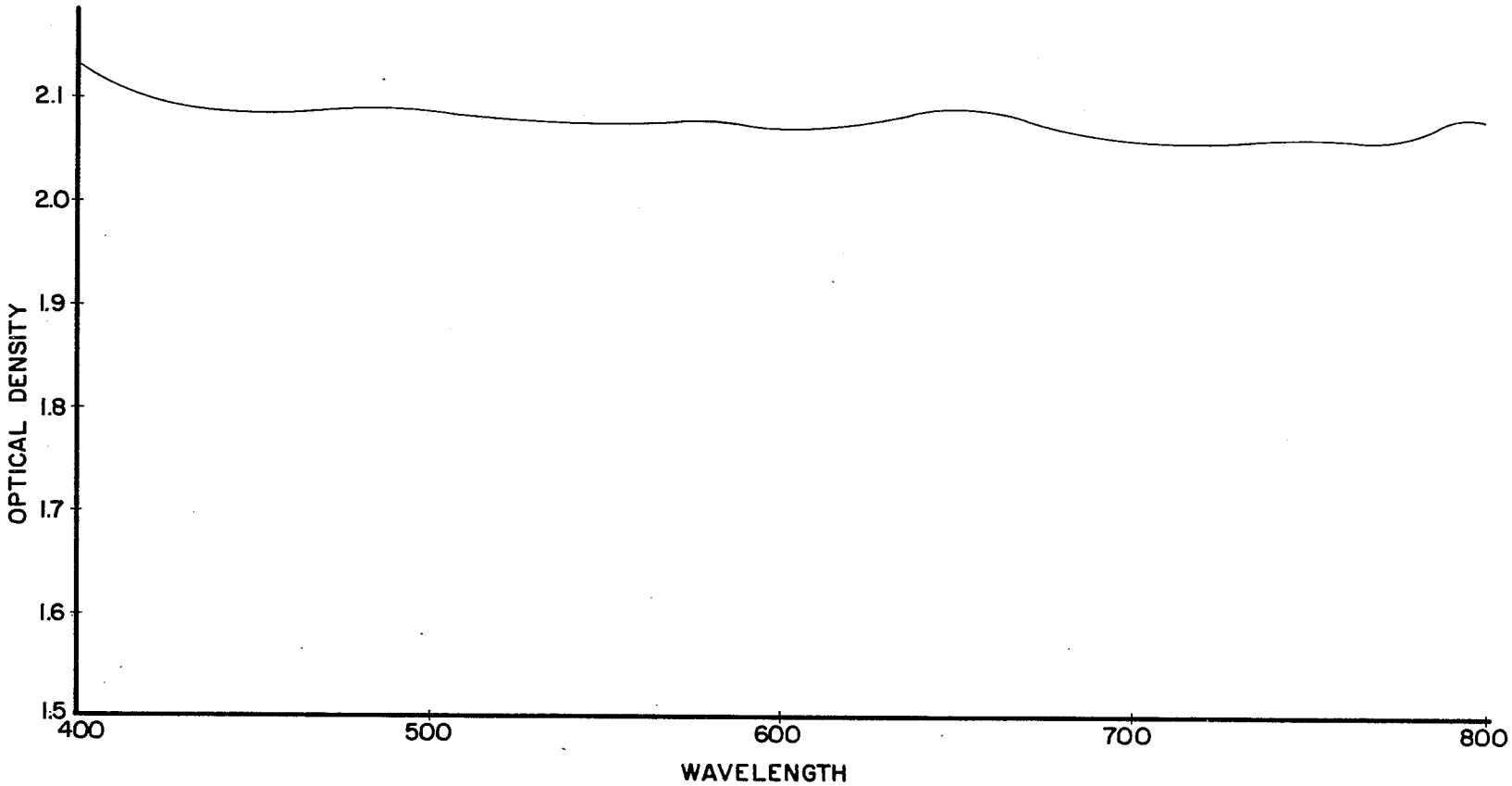
FIG. 4 is a spectral transmission curve for a silver image deposited on the novel image-receiving element of the present invention.

When the novel image-receiving element of the present invention is employed in silver diffusion transfer processing, the image formed therein is cahracterized by a uniform mirror deposit of image silver as a result of the relatively thin nuclei layer employed. The positive silver is more dense than that generally found in prior art image-receiving elements and is similar in properties to that obtained by vacuum deposited silver, which is the most compact form possible. The above-mentioned mirror can be used for printed circuits as evidenced by resistivity measurements which range from 3 to 20 ohms/cm. The absorption spectra is relatively neutral, i.e., similar to vacuum deposited silver. Thus, by means of the present invention, a thin, tightly packed matrix of nuclei can be prepared so that the silver deposited thereon is similar to vacuum deposited silver, the most compact form possible. FIG. 4, a transmission curve for a silver image which will be described further below, illustrates the above-mentioned relatively neutral absorption spectra.

As stated above, the method of preparing the inorganic stannic oxide polymer is relatively simple. A metal, e.g., tin, is heated in a solution of stannic chloride and then decanted or filtered to remove excess unreacted metal.

To apply the tin hydrosol to the support, a substrate such as a sheet of polyester is dipped in a solution for about 1–40 seconds, rinsed with water, optionally dried and then dipped in a nuclei-forming solution, e.g., a 0.25 to 0.0001M solution of, for example, potassium palladous tetrachloride ($K_2PdCl_4$), for about 5 to 40 seconds. It has been found that neither the concentration of the reactants nor the treatment time is critical. Generally, a layer of about 0.1 to 1.0 mgs./ft.$^2$ of noble metal is employed.

As examples of noble metal salts or complexes suitable for use in the present invention, mention may be made of compounds of silver, gold, palladium, platinum and rhodium. Combinations of noble metals may be used as well as single noble metals. The noble metals may be reduced on the tin hydrosol from aqueous salts of the noble metals. Suitable noble metal compounds include the following:

$K_2PdCl_4$
$PdCl_2$
$H_2PtCl_6$
$AgNO_3$
$HAuCl_4$
$(NH_4)_3RhCl_6$

The following nonlimiting example illustrates the preparation of the inorganic stannic oxide polymer hydrosol.

EXAMPLE I

To 1500 ml. of water was added 300 g. stannic chloride ($SnCl_4 \cdot 5H_2O$) and 134 g. mossy tin. The solution was heated with stirring to 85° C., allowed to cool and then decanted.

The following nonlimiting examples illustrate the preparation of the image-receiving elements of the present invention.

EXAMPLE II

A sheet of 5 mil transparent polyester film was dipped into a 20% solution of tin hydrosol as prepared in Example I for 20 seconds. The thus-coated sheet was then washed with distilled water an then dipped into a solution of 0.1 molar of silver nitrate for 20 seconds. The thusformed image-receiving element was again washed with distilled water.

EXAMPLE III

An image-receiving element was prepared according to the procedure of Example II except that 0.14M of $HAuCl_4$ was used instead of silver nitrate and the contact time of the gold solution with the inorganic stannic oxide polymer was 40 seconds.

EXAMPLE IV

An image-receiving element was prepared according to the procedure of Example II except that 0.00014M of $HAuCl_4$ was used instead of silver nitrate and the contact time of the gold solution with the inorganic stannic oxide polymer was 5 seconds.

EXAMPLE V

An image-receiving element was prepared according to the procedure of Example II except that 0.25M of $K_2PdCl_4$ was used instead of silver nitrate and the contact time of the palladium solution with the inorganic stannic oxide polymer was 10 seconds.

EXAMPLE VI

An image-receiving element was preapred according to the procedure of Example II except that 0.1M of $(NH_4)_3RhCl_6$ was used instead of silver nitrate.

The image-receiving elements of the present invention are illustrated by the results tabulated below obtained by substituting the image-receiving elements of the present invention for the image-receiving element in the Polaroid Type 107 Land film (sold by Polaroid Corporation, Cambridge, Massachusetts). The photosentive element was exposed to a conventional step wedge and then processed for 15 seconds. The image-receiving elements were then separated from the photosentive elements.

The maximum transmission densities of the elements are set forth below.

TABLE I

| Image-receiving Element Example No. | Noble Metal Nuclei | $D_{max}$ Transmission Density |
|---|---|---|
| II | Ag | 1.45 |
| III | Au | 0.5 |
| IV | Au | 1.1 |
| V | Pd | 1.15 |
| VI | Rh | 0.24 |

EXAMPLE VII

A transparent polyester film base having a coating of polyvinyl formal on one side was dipped into a 15% solution of tin hydrosol as prepared in Example I for 20 seconds, rinsed with water for 20 seconds, dipped into a solution of 0.01M $K_2PdCl_4$ for 20 seconds, then rinsed with water for 20 seconds and air dried. This receiving sheet was designated VII-A.

A transparent polyester film base having a coating of polyvinyl formal on one side was dipped into a 50% solution of tin hydrosol for 20 seconds, rinsed with water for 20 seconds, dipped into a solution of 0.01M $K_2PdCl_4$ for 20 seconds, rinsed with water for 20 seconds, dipped into the solution of tin hydrosol for 20 seconds, rinsed with water for 20 seconds, dipped into the $K_2PdCl_4$ solution for 20 seconds, rinsed with water for 20 seconds and air dried. This receiving sheet was designated VII-B.

The receiving units were then evaluated as a component of the Type 107 film units as described above. The following results were obtained:

| | Transmission Density ($D_{max}$) | Tone |
|---|---|---|
| VII-A | 0.62 | black-green |
| VII-B | 1.32 | neutral |

It has also been found that one or more additional metals may be employed in conjuction with the noble metal. The additional metal may be noble or non-noble.

The following table illuastrates the results obtained with various systems within the scope of the present invention. Receiving elements were prepared by dipping a transparent polyester film base in a 20% solution of the tin hydrosol of Example I for 20 seconds, rinsed with water for 20 seconds, dipped into a solution of $K_2PdCl_4$ for 20 seconds, rinsed for 20 seconds with water, dipped into a solution of a salt of the second metal for 20 seconds, rinsed with water for 20 seconds and air dried. The thusformed image-receiving elements were processed as above in a Type 107 format. The results are set forth in the table.

TABLE 2

| Noble Metal/Additional metal | Transmission Density Neutral | Red | Green | Blue | Tone |
|---|---|---|---|---|---|
| 0.1M $K_2PdCl_4$/Cu* | .60 | .55 | .63 | .65 | blue-black |
| 0.1M $K_2PdCl_4$/0.1M $Cu(NO_3)_2$ | .57 | .47 | .61 | .63 | blue-black |
| .01M $K_2PdCl_4$/0.01M $Cu(NO_3)_2$ | .57 | .53 | .57 | .60 | blue |
| .01M $K_2PdCl_4$/0.1M Copper acetate | .79 | .73 | .80 | .74 | purple-black |
| 0.01M $K_2PdCl_4$/0.01M Copper acetate | .64 | .57 | .69 | .71 | purple-black |
| 0.01M $K_2PdCl_4$/0.01M $Co(NO_3)_2$ | .65 | .61 | .67 | .63 | purple |
| 0.01M $K_2PdCl_4$/0.1M $Co(NO_3)_2$ | .53 | .47 | .57 | .59 | blue-black |
| 0.01M $K_2PdCl_4$/0.0014 M $HAuCl_3$ | .99 | 1.01 | .97 | 1.11 | green |
| 0.01M $K_2PdCl_4$/0.1M NiCl | .93 | .90 | .96 | 1.12 | black |
| 0.01M $K_2PdCl_4$/0.0014M $HAuCl_4$/0.1M $AgNO_3$ | 1.22 | 1.15 | 1.25 | 1.40 | black |
| 0.01M $K_2PdCl_4$/0.1M $TiO(SO_4)$ | .38 | 1.02 | .90 | 1.05 | green |
| 0.01M $K_2PdCl_4$/0.01 M $VO(SO_4)$ | .50 | .65 | .70 | .94 | green |
| 0.01M $K_2PdCl_4$/0.1M $VO(SO_4)$ | 1.11 | 1.13 | 1.17 | 1.25 | blue |
| 0.01M $K_2PdCl_4$/0.01M $Ni(SO_4)$ | 1.00 | 1.12 | 1.18 | 1.30 | purple-black |
| | .56 | .60 | .55 | .58 | green-black |
| 0.01M $K_2PdCl_4$/0.1M $Ni(SO)_4$ | .63 | .57 | .68 | .72 | brown |
| 0.01M $K_2PdCl_4$10.01M $Cu(SO_4)$ | .55 | .57 | .56 | .58 | green-black |
| 0.01M $K_2PdCl_4$/0.1M $Cu(SO_4)$ | .60 | .64 | .62 | .65 | brown-black |
| 0.005M $K_2PdCl_4$/0.0007M $HAuCl_4$ | 1.14 | 1.15 | 1.14 | 1.17 | |
| 0.0010M $K_2PdCl_4$/0.0014M $HAuCl_4$ | 1.45 | 1.47 | 1.38 | 1.29 | |

*The copper was provided by mixing the following solutions:
A. $CuSO_4 \cdot 5H_2O$ 10 gms.

TABLE 2-continued

| Noble Metal/Additional metal | | Transmission Density Neutral | Red | Green | Blue | Tone |
|---|---|---|---|---|---|---|
| Formaldehyde (37%) | 60 mls. | | | | | |
| Methanol | 300 mls. | | | | | |
| Distilled water | to make 1 liter | | | | | |
| B. Sodium hyroxide (50%) | 80 gms. | | | | | |
| Potassium-sodium tartrate | 28 gms. | | | | | |
| Distilled water | to make 1 liter | | | | | |

The following nonlimiting example illustrates the utility of the novel image-receiving elemetns of the present invention in an integral film unit of the aforementioned type.

EXAMPLE VIII

A film unit was prepared comprising a transparent polyester film base carrying on one surface an additive color screen of approximately 1000 triplet sets per inch of red, blue and green filter screen elements in repetitive side-by-side relationship; a protective overcoat comprising a layer of a polyvinylidine chloride copolymer and a layer of polyvinyl butyral; a nucleating layer of the inorganic stannic oxide polymer having palladium reduced thereon prepared by coating the polyvinyl butyral layer with the inorganic stannic oxide polymer of Example I and then contacting the inorganic polymer layer with 0.01M potassium palladous tetrachloride by immersion for 30 seconds; a panchromatically sensitized hardened gelatino silver iodochlorobromide emulsion coated at a coverage of about 115 mgs./ft.$^2$ of gelatin and about 100 mgs./ft.$^2$ of silver with about 7.18 mgs./ft.$^2$ propylene glycol alginate and about 0.45 mg./ft.$^2$ of sodium dioctyl sulfosuccinate; and an antihalation top coat comprising about 220 mgs./ft.$^2$ of gelatin, about 5.7 mgs./ft.$^2$ of a silver salt of a dye of the formula:

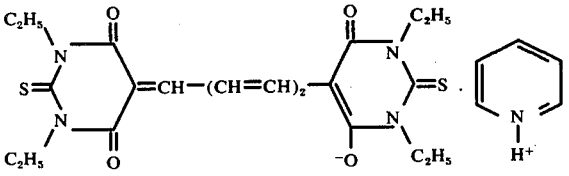

and about 7.17 mgs./ft.$^2$ of a dye of the formula:

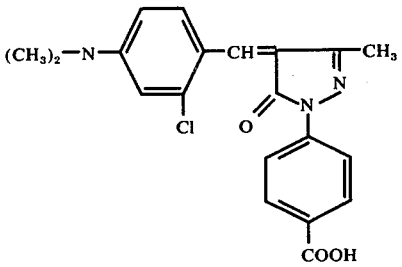

about 0.380 mg.ft.$^2$ of a commercial dispersing agent (Daxad 11 sold by W. R. Grace and Company, Cambridge, Massachusetts); about 0.847 mg./ft.$^2$ of a commercial surfactant sold by Rohm & Haas Company, Philadelphia, Pennsylvania under the trade name Triton X-100; about 18.01 mgs./ft.$^2$ of gold mercaptobenzimidazole. The above-described antihalation topcoat is disclosed and claimed in copending application Ser. No. 383,261 filed July 27, 1973.

The above-described film unit was exposed to a conventional step wedge and was developed by contacting the film unit for about 60 seconds with a processing composition comprising:

| | |
|---|---|
| Sodium hydroxide | 1763 g. |
| Hydroxyethyl cellulose (high viscosity) | 150 g. |
| Tetramethyl reductic acid | 2775 g. |
| Sodium sulfite | 199 g. |
| N-benzyl-α-picolinium bromide | 198.75 g. |
| Sodium thiosulfate | 308.3 g. |
| Water | 16894 cc. |

Figure 5:
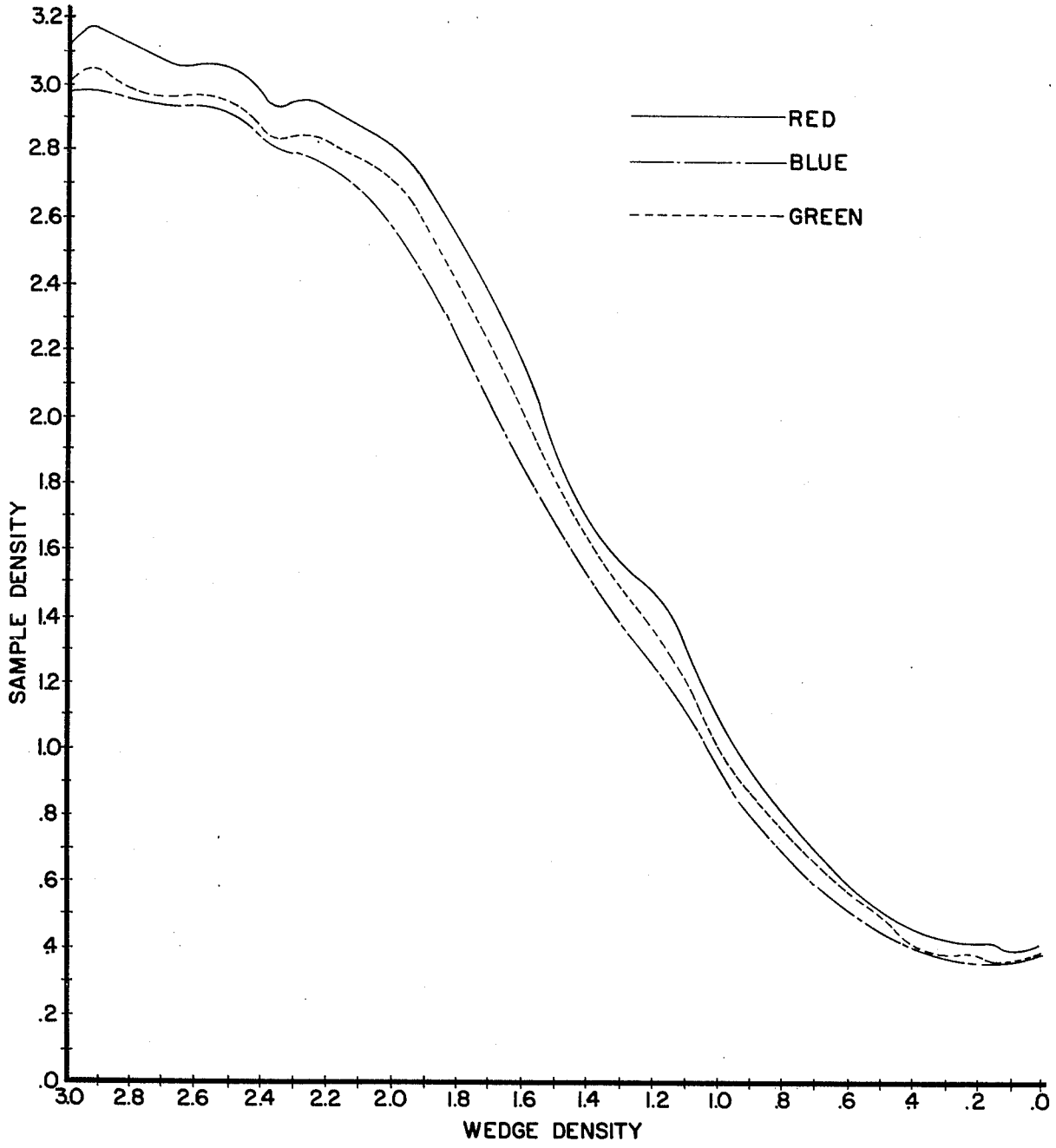
FIG. 5 is a characteristic curve of a silver transfer image in a receiving element of the present invention prepared by plotting the neutral column transmission density to red, green and blue light as a function of exposure of the silver halide emulsion.

Characteristic curves, reproduced herein as FIG. 5, were prepared by plotting the neutral column density to white light and to the red, green and blue light as a function of exposure $D_{max}$ transmission density of ~ 3.0 to white light and a $D_{min}$ of ~ 0.3 to white light were measured. The image showed quite neutral tone and the image silver was highly compact. The curve in FIG. 4 was obtained on a film unit similar to that described in Example VIII processed in the same manner and with the same processing composition, and illustrates the neutral tone of the image.

To illustrate the relatively thin receiving layer obtainable by means of the present invention as well as the compact, dense positive silver image obtainable by diffusion transfer processing, reference may be made to FIGS. 6 through 11.

Figure 6:
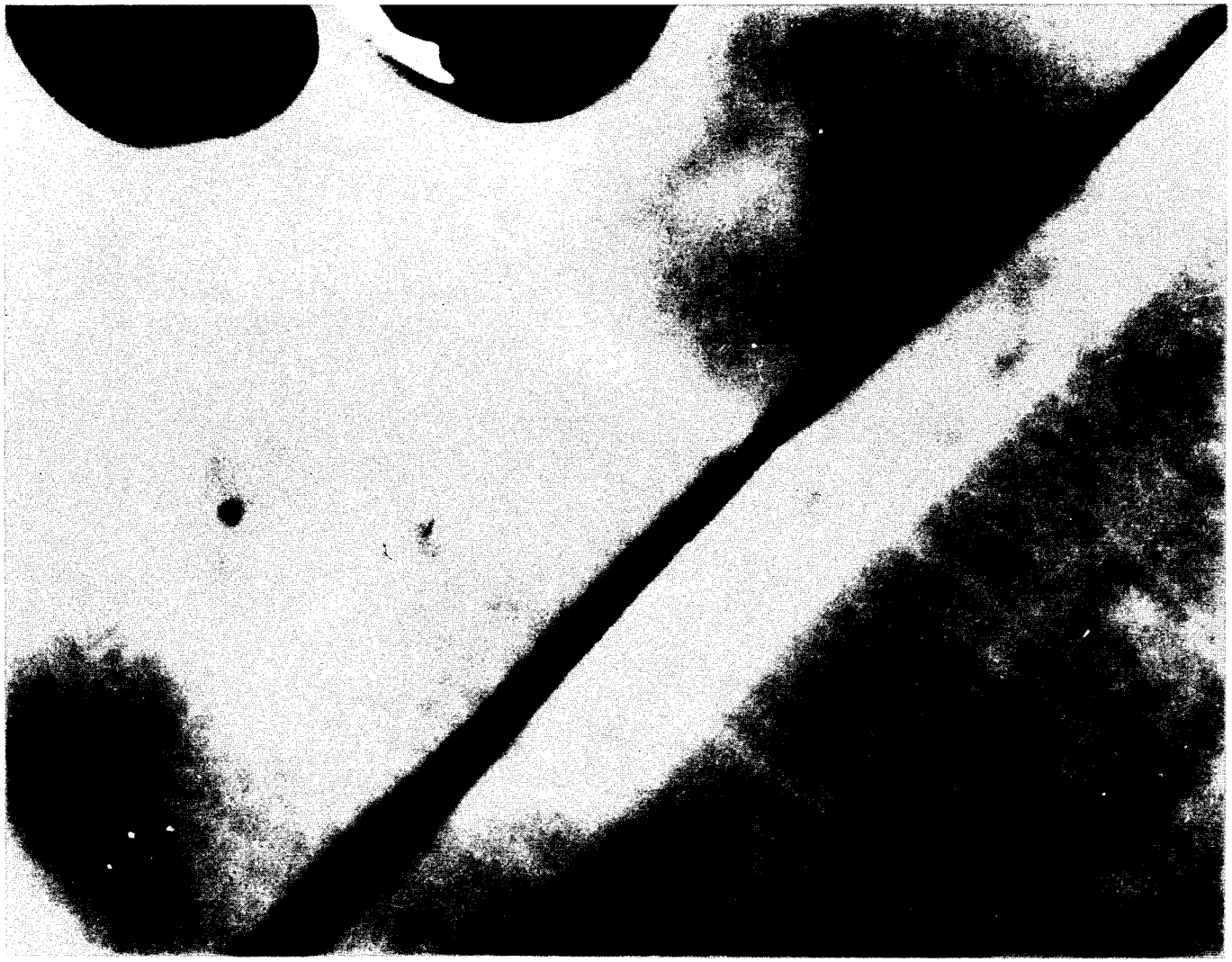
FIG. 6 is an electron micrograph of a cross-section of an unprocessed image-receiving element of the present invention.

FIG. 6 is an electron micrograph of 100,000 magnification of a cross section of a film unit prepared according to the procedure of Example VIII wherein 11 is the protective overcoat, 13 is the nucleating layer and 15 is the emulsion layer.

Figure 7:
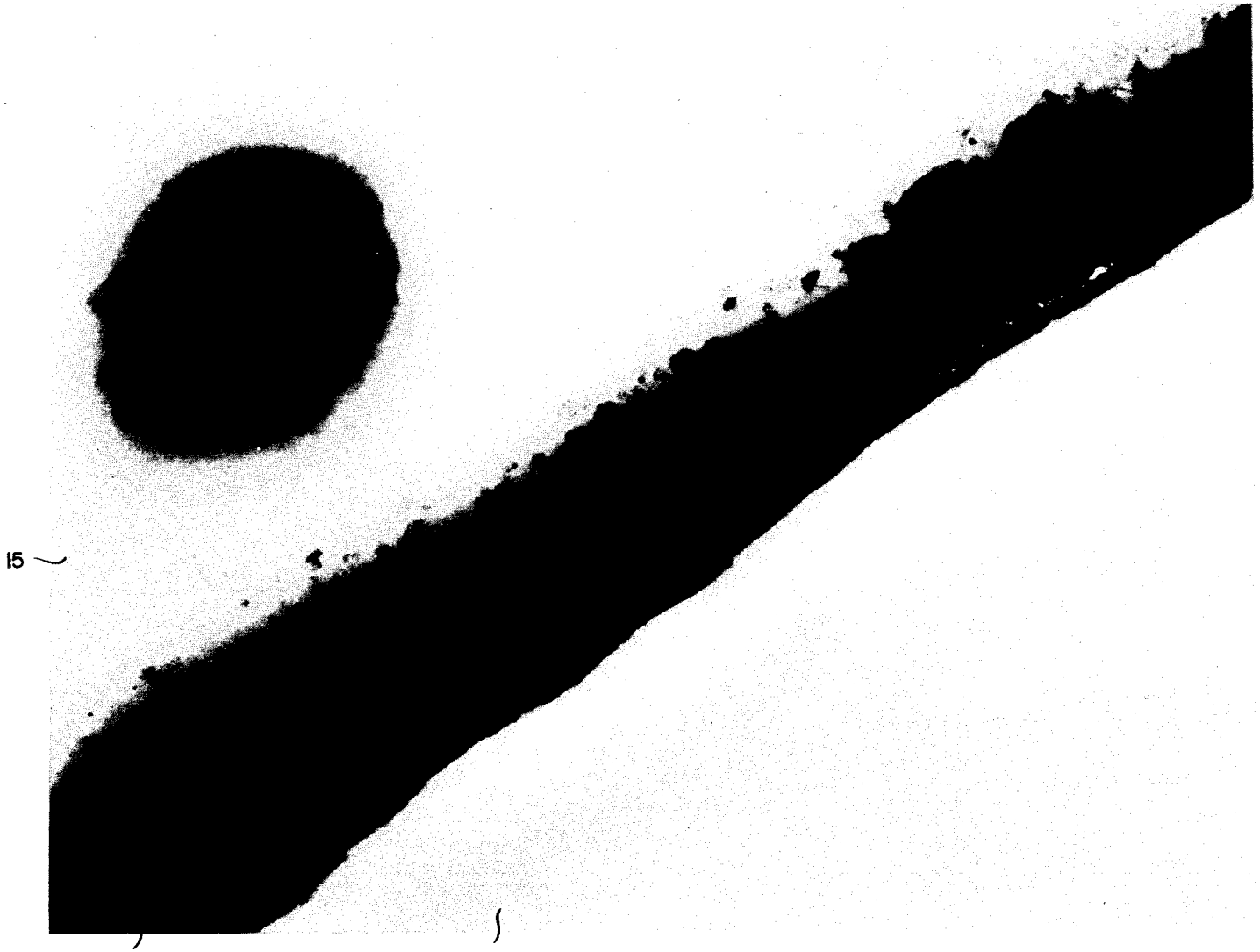
FIG. 7 is an electron micrograph of the image-receiving element of FIG. 6 after processing.

FIG. 7 shows the film unit of FIG. 6 after processing wherein the positive silver image 14 has been deposited in the receiving layer. The dense, compact silver layer can be seen.

Figure 8:
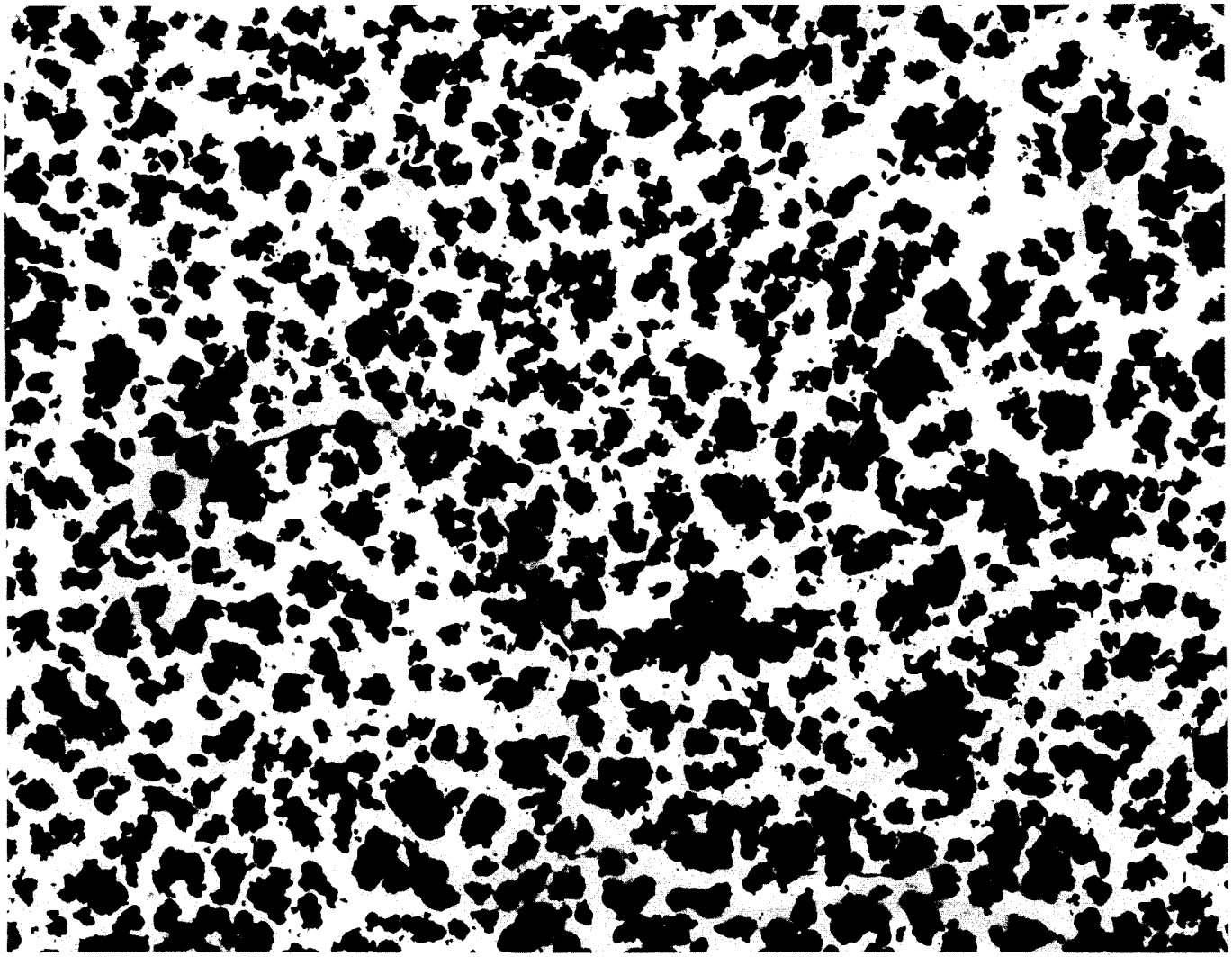
FIG. 8 is an electron micrograph of a top view of the image-receiving element of FIG. 7.

FIG. 8 is a top view of 40,000 magnification of the positive silver image 14 of FIG. 7 with the top coat and emulsion removed. The denseness of the silver packing is evident.

Figure 9:
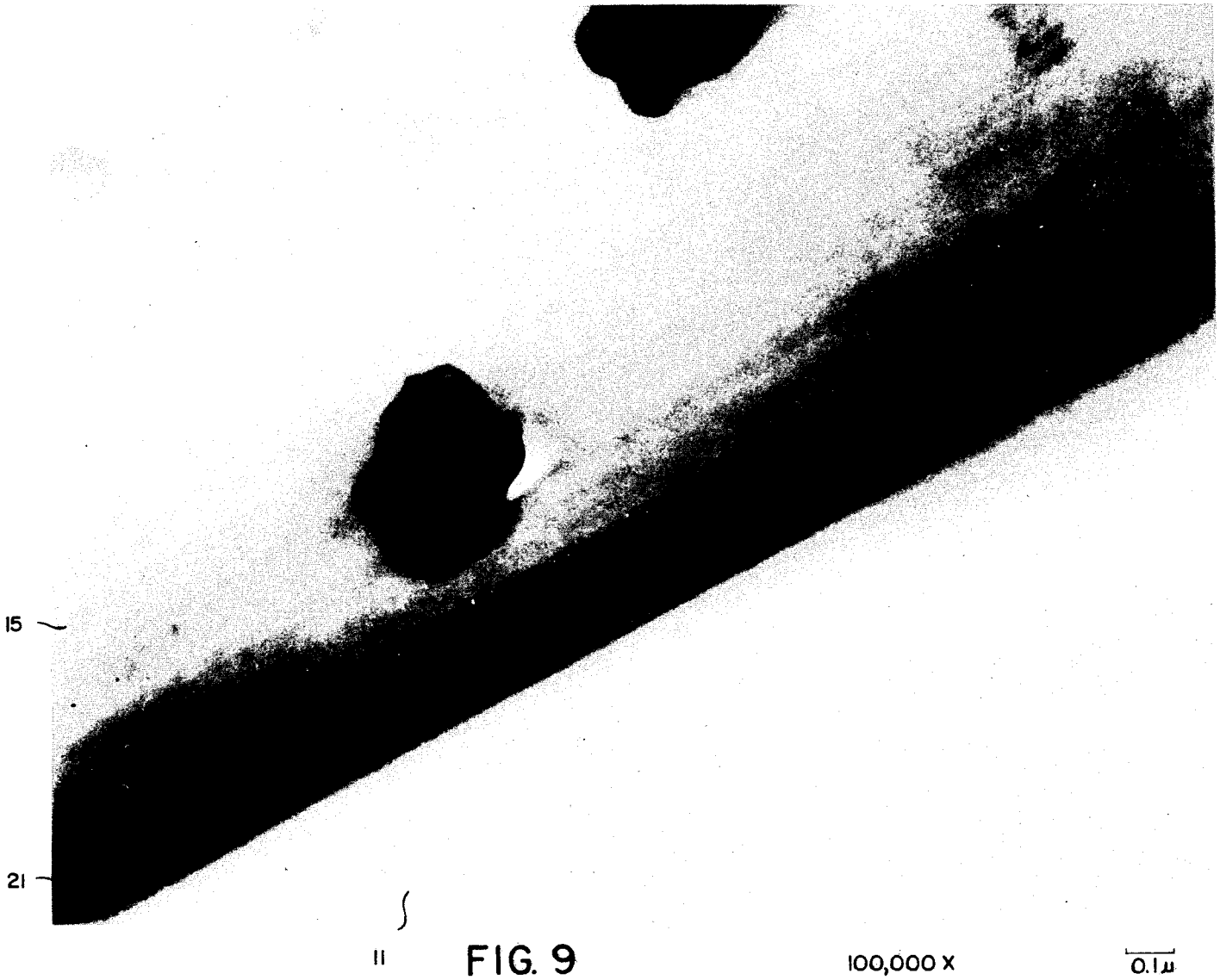
FIG. 9 is an electron micrograph of a cross-section of a prior art unprocessed image-receiving element.
Figure 10:
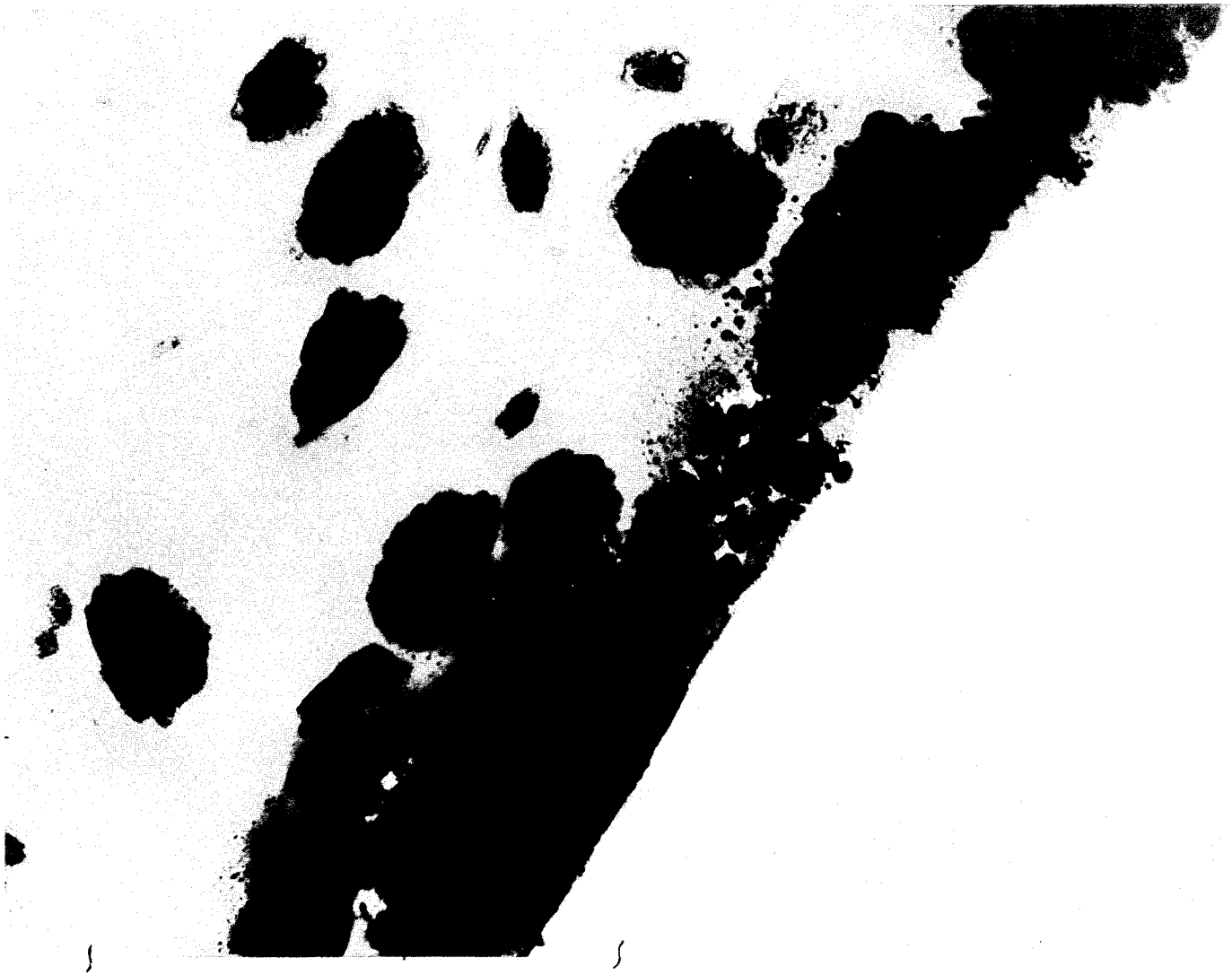
FIG. 10 is an electron micrograph of the image-receiving element of FIG. 9 after processing.
Figure 11:
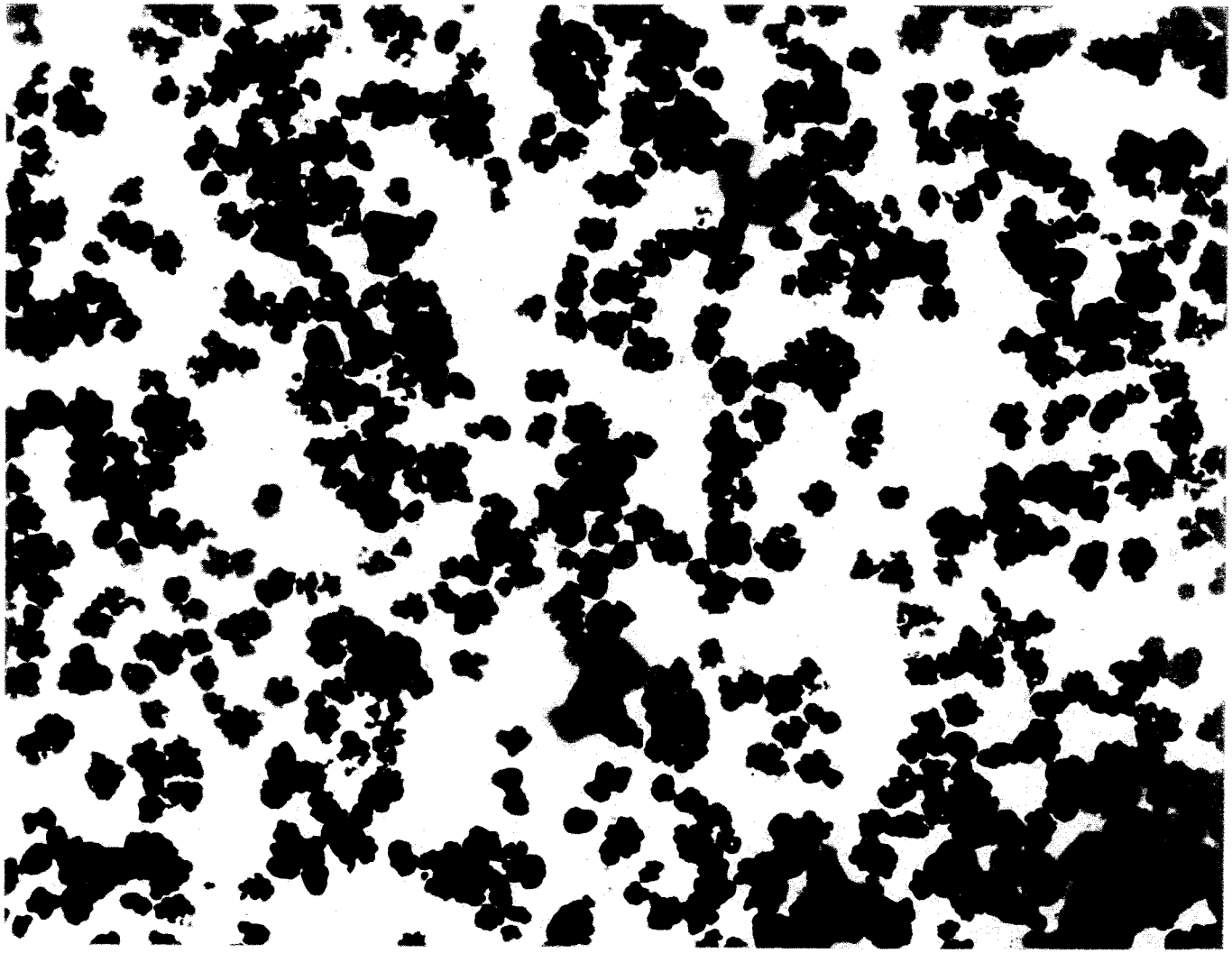
FIG. 11 is an electron micrograph of a top view of the image-receiving element of FIG. 10.

For comparison, film units were prepared using a prior art copper sulfide nucleating layer and are shown in FIGS. 9, 10 and 11. FIG. 9 is a prior art film unit showing protective overcoat 11, nucleating layer 21 carrying copper sulfide nuclei in a polymeric binder and emulsion layer 15. It will be noted that the prior art nucleating layer is 3 to 4 times as thick as the receiving layer of the present invention. FIGS. 10 and 11, which correspond to FIGS. 7 and 8, respectively, do not show the compact, dense positive silver deposition achieved in the present invention as illustrated in FIGS. 10 and 11.

The support employed in the present invention is not critical. The support or film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate-butyrate; or acetate propionate; polycarbonates; polystyrenes; and the like.

The adhesion of tin hydrosols to various negatively charged surfaces is well known and thus subcoats and surface treatments such as corona discharge are generally not required.

What is claimed is:

1. A photographic image-receiving element for use in silver diffusion transfer processes which comprises a support carrying a layer of an inorganic stannic oxide polymer hydrosol, said polymer having a noble metal reduced thereon, wherein said inorganic stannic oxide polymer hydrosol comprises stannic oxide monomeric units and metallic oxide monomeric units of a metal having a valence of +2 or +3.

2. A product as defined in claim 1 wherein said polymer is comprised of stannic oxide units of the formula:

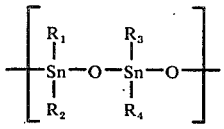

wherein at least one of the groups $R_1$, $R_2$, $R_3$ and $R_4$ is —OH or —O— and at least one of the groups $R_1$, $R_2$, $R_3$ and $R_4$ is an anion of a water soluble salt of tin and the remainder of the groups $R_1$, $R_2$, $R_3$ and $R_4$ are —OH-,—O— or an anion of a water-soluble salt of tin and wherein said polymer contains a second type of monomeric unit selected from the group consisting of metal oxide monomers of the formulae:

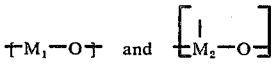

and mixtures thereof, wherein $M_1$ is a metallic ion of a metal having a valence of +2 and $M_2$ is a metallic ion of a metal having a valence of +3.

3. A product as defined in claim 2 wherein said metallic ions $M_1$ and $M_2$ are selected from the group consisting of iron, cobalt, nickel, bismuth, lead, titanium, vanadium, chromium, copper, molybdenum, antimony, tungsten and tin.

4. The product as defined in claim 1 wherein said noble metal is selected from the group consisting of gold, platinum, palladium, silver, rhodium, and combinations thereof.

5. The product as defined in claim 1 which includes a second metal reduced on said polymer.

6. The product as defined in claim 4 wherein said noble metal is palladium.

7. The product as defined in claim 1 which includes a photosensitive silver halide emulsion layer associated therewith.

8. The product as defind in claim 7 wherein said image-receiving element and said emulsion layer are coated on the same support.

9. In a silver diffusion transfer process, the steps which comprise developing an exposed photographic silver halide emulsion with a diffusion transfer processing composition, forming an imagewise distribtuion of soluble silver complex as a function of the point-to-point degree of exposure thereof, and transferring, by imbibition, at least part of said imagewise distribtuion of said soluble silver complex to a superposed image-receiving layer to thereby provide a silver transfer image to said image-receiving layer, the improvement wherein said image-receiving layer comprises a support carrying a layer of inorganic stannic oxide polymer hydrosol, said polymer having a noble metal reduced thereon, wherein said inorganic stannic oxide polymer hydrosol comprises stannic oxide monomeric units and metallic oxide monomeric units of a metal having a valence of +2 and +3.

10. A process as defined in claim 9 wherein said polymer is comprised of a major amount of stannic oxide units of the formula:

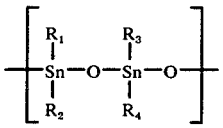

wherein at least one of the groups $R_1$, $R_2$, $R_3$ and $R_4$ is—OH or —O— and at least one of the groups $R_1$, $R_2$, $R_3$ and $R_4$ is an anion of a water soluble salt of tin and the remainder of the groups of $R_1$, $R_2$, $R_3$ and $R_4$ are OH,—O— or an anion of a water soluble salt of tin and wherein said polymer contains a second type of monomeric unit selected from the group consisting of metal oxide monomers of the formulae:

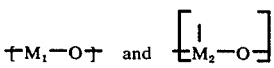

and mixtures thereof, wherein $M_1$ is a metallic ion of a metal having a valence of +2 and $M_2$ is a metallic ion of a metal having a valence of +3.

11. A process as defined in claim 10 wherein said metallic ions $M_1$ and $M_2$ are selected from the group consisting of iron, cobalt, nickel, bismuth, lead, titanium, vanadium, chromium, copper, molybdenum, antimony, tungsten and tin.

12. A process as defined in claim 9 wherein said noble metal is selected from the group consisting of gold, platinum, palladium, silver, rhodium and combinations thereof.

13. A process as defined in claim 9 which includes a second metal reduced on said polymer.

14. A process as defined in claim 12 wherein said noble metal is palladium.

15. A photographic element comprising a support carrying a layer of an inorganic stannic oxide polymer hydrosol thereon, said polymer having a substantially uniform layer of a noble metal reduced thereon, said element further including an imagewise distribution of silver on said layer said inorganic stannic oxide polymer hydrosol comprising stannic oxide monomeric units and metallic oxide monomeric units of a metal having a valence of +2 or +3.

16. A photographic film unit which comprises a transparent support carrying, in order, an additive multi-color screen, a silver precipitating nuclei layer and a layer comprising photosensitive silver halide crystals, wherein said silver precipitating layer comprises a layer of an inorganic stannic oxide polymer hydrosol, said polymer having a noble metal reduced thereon said inorganic stannic oxide polymer hydrosol comprising stannic oxide monomeric units and metallic oxide monomeric units of a metal having a valence of +2 or +3.

17. A film unit as defined in claim 16 which includes a substantially processing composition permeable polymeric layer intermediate said silver precipitating layer and said layer comprising photosensitive silver halide crystals.

18. A film unit as defined in claim 16 wherein said photosensitive silver halide layer has a silver coverage of not more than about 200 mgs./ft.$^2$.

19. A film unit as defined in claim 16 wherein said screen is a trichromatic screen possessing red, green and blue optical filter elements.

20. A product as defined in claim 16 wherein said polymer is comprised of stannic oxide units of the formula:

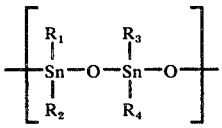

wherein at least one of the groups $R_1$, $R_2$, $R_3$ and $R_4$ is —OH or —O— and at least one of the groups $R_1$, $R_2$, $R_3$ and $R_4$ is an anion of a water soluble salt of tin and the remainder of the groups $R_1$, $R_2$, $R_3$ and $R_4$ are —OH, —O— or an anion of a water soluble salt of tin and wherein said polymer contains a second type of monomeric unit selected from the group consisting of metal oxide monomers of the formulae:

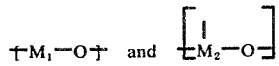

and mixtures thereof, wherein $M_1$ is a metallic ion of a metal having a valence of +2 and $M_2$ is a metallic ion of a metal having a valence of +3.

21. A product as defined in claim 20 wherein said metallic ions $M_1$ and $M_2$ are selected from the group consisting of iron, cobalt, nickel, bismuth, lead, titanium, vanadium, chromium, copper, molybdenum, antimony, tungsten and tin.

22. The product as defined in claim 16 wherein said noble metal is selected from the group consisting of gold, platinum, palladium, silver, rhodium, and combinations thereof.

23. A photographic process which comprises, in combination, the steps of:

a. exposing to incident actinic radiation a photographic film unit comprising, in order, a transparent support carrying an additive multicolor screen comprising red, green and blue optical filter elements in a screen pattern, a silver precipitating layer, a substantially processing composition permeable polymeric layer, a layer comprising photosensitive silver halide, said silver precipitating layer comprising an inorganic stannic oxide polymer hydrosol having a noble metal reduced thereon said inorganic stannic oxide polymer comprising stannic oxide monomeric units and metallic oxide monomeric units of a metal having a valence of +2 or +3; and b. contacting the exposed element with a processing composition comprising a silver halide solvent and a silver halide developing agent to thereby provide to the element a silver transfer image in terms of the unexposed areas of said silver halide layer, as a function of the point-to-point degree of exposure thereof; said silver transfer image being viewable without separation of said silver precipitating layer and said silver halide layer.

* * * * *